US007768373B2

(12) United States Patent
Shudarek

(10) Patent No.: US 7,768,373 B2
(45) Date of Patent: Aug. 3, 2010

(54) COMMON MODE, DIFFERENTIAL MODE THREE PHASE INDUCTOR

(75) Inventor: Todd Alexander Shudarek, West Bend, WI (US)

(73) Assignee: Cramer Coil & Transformer Co., Inc., Saukville, WI (US)

( * ) Notice: Subject to any disclaimer, the term of this patent is extended or adjusted under 35 U.S.C. 154(b) by 0 days.

(21) Appl. No.: 12/337,454

(22) Filed: Dec. 17, 2008

(65) Prior Publication Data

US 2009/0261939 A1 Oct. 22, 2009

Related U.S. Application Data

(60) Provisional application No. 61/046,939, filed on Apr. 22, 2008, provisional application No. 61/084,668, filed on Jul. 30, 2008.

(51) Int. Cl.
*H01F 27/24* (2006.01)

(52) U.S. Cl. ..... 336/212; 336/214; 336/215

(58) Field of Classification Search ..... 336/214, 336/215, 212

See application file for complete search history.

(56) References Cited

U.S. PATENT DOCUMENTS

| | | | | |
|---|---|---|---|---|
| 4,134,055 | A | 1/1979 | Akamatsu | |
| 4,910,482 | A | 3/1990 | Takagai et al. | |
| 5,083,101 | A | 1/1992 | Frederick | |
| 5,155,676 | A | 10/1992 | Spreen | |
| 5,313,176 | A | 5/1994 | Upadhyay | |
| 5,319,343 | A | 6/1994 | Jeffries | |
| 5,321,373 | A | 6/1994 | Shusterman et al. | |
| 5,581,224 | A | 12/1996 | Yamaguchi | |
| 5,686,806 | A * | 11/1997 | Hibbard | 318/800 |
| 5,731,666 | A | 3/1998 | Folker et al. | |
| 5,990,654 | A | 11/1999 | Skibinski et al. | |
| 6,617,950 | B2 | 9/2003 | Gilmore et al. | |
| 6,642,672 | B2 | 11/2003 | Hu et al. | |
| 6,768,408 | B2 | 7/2004 | Gilmore et al. | |
| 2004/0135661 | A1 | 7/2004 | Haugs et al. | |
| 2006/0061325 | A1 | 3/2006 | Tang et al. | |
| 2006/0152324 | A1 | 7/2006 | Haugs et al. | |
| 2006/0220777 | A1 | 10/2006 | Nakahori | |
| 2006/0250207 | A1 * | 11/2006 | Shudarek | 336/212 |
| 2007/0115087 | A1 | 5/2007 | Lee et al. | |
| 2008/0074227 | A1 * | 3/2008 | Chen et al. | 336/160 |

OTHER PUBLICATIONS

International Search Report and Written Opinion of Application No. PCT/US08/87251 dated Feb. 3, 2009 (10 pages) .

* cited by examiner

*Primary Examiner*—Elvin G Enad
*Assistant Examiner*—Ronald W Hinson
(74) *Attorney, Agent, or Firm*—Michael Best & Friedrich LLP

(57) ABSTRACT

An inductor includes common mode and differential mode flux paths. The inductor comprises a first core having a first segment, a second segment extending from the first segment and a first bridge segment extending from the second segment; a first wiring arrangement at least partially disposed around the first segment; a second core having a third segment, a fourth segment extending from the third segment and a second bridge segment extending from the fourth segment; and a second wiring arrangement at least partially disposed around the third segment; wherein the first segment, second segment, third segment and fourth segment cooperate to promote the common mode flux path, and the first bridge segment and the second bridge segment cooperate to promote the differential mode flux path.

26 Claims, 14 Drawing Sheets

COMMON MODE, DIFFERENTIAL MODE THREE PHASE INDUCTOR

REFERENCE TO RELATED APPLICATIONS

This application claims the benefit of U.S. Provisional Patent Application No. 61/046,939 filed on Apr. 22, 2008, and U.S. Provisional Patent Application No. 61/084,668 filed on Jul. 30, 2008.

BACKGROUND

Three phase differential mode harmonics are typically filtered by placing three inductors in series with the line between the drive and motor. Common-mode harmonics are typically filtered by placing three parallel conductors on one magnetic core path.

With relation to three phase AC motor controllers, particularly pulse width modulation (PWM) voltage source inverters (VSI), each phase of the three phases of a motor is connected to a VSI by a separate conductor. PWM VSI's operate by switching a DC voltage at a high frequency. All multiple conductor wire runs contain stray inductance and stray capacitance. This creates the possibility of a series resonant circuit in the motor cable system. The longer the motor cables, the lower the resonant frequency. The output of a PWM VSI Drive contains switching frequencies that can excite this natural resonance. If the switching frequency of the output power devices is high enough, and if the resonant frequency of the motor cable system is low enough, voltage spikes at the AC Motor terminals can easily reach double the DC bus voltage. These elevated voltages can cause premature failure of motors or damage the cables supplying the motor.

SUMMARY

In one embodiment, the invention provides an inductor core structure that, when assembled, forms common mode and differential mode flux paths.

In another embodiment, the invention provides a core assembly having an outer hexagonal shape.

In another embodiment, the invention provides a core assembly having three inner-bridge structures.

In another embodiment, the invention provides a core assembly having an outer shape (e.g., a hexagonal shape) to provide a common mode flux path. The core assembly further has three inner-bridge structures to provide respective differential mode flux paths.

In another embodiment, the invention provides a core assembly having three core structures. Each core structure includes a leg and a bridge. The assembled core can be used in an inductor. The inductor includes three or six coils. Each coil is at least partially disposed around a leg. The inductor can reduce space and cost by integrating both the common mode and differential mode inductors onto one core assembly.

In another embodiment, the invention provides a common mode and differential mode inductance assembly that includes three substantially identical core shapes that form a hexagonal outer surface shape. Three alternating legs of the hexagonal outside surface shape have a bridge that extends toward the center of the core. Each of the other three legs of the hexagonal shapes has a wiring arrangement comprised of one or two coils. The magnetic flux that flows through the core bridges is substantially differential mode flux. The magnetic flux that flows completely through the outer hexagonal shape is substantially common mode flux.

In one embodiment, the invention provides an inductor including common mode and differential mode flux paths, the inductor comprising: a first core having a first segment, a second segment extending from the first segment and a first bridge segment extending from the second segment; a first wiring arrangement at least partially disposed around the first segment; a second core having a third segment, a fourth segment extending from the third segment and a second bridge segment extending from the fourth segment; and a second wiring arrangement at least partially disposed around the third segment; wherein the first segment, second segment, third segment and fourth segment cooperate to promote the common mode flux path, and the first bridge segment and the second bridge segment cooperate to promote the differential mode flux path.

In another embodiment, the invention provides a method of manufacturing an inductor having common mode and differential flux paths, the method comprising: providing a first core having a first segment, a second segment extending from the first segment and a first bridge segment extending from the second segment; disposing a first wiring arrangement at least partially around the first segment; providing a second core having a third segment, a fourth segment extending from the third segment and a second bridge segment extending from the fourth segment; disposing a second wiring arrangement at least partially around the third segment; and placing the first core adjacent the second core such that the first segment, second segment, third segment and fourth segment cooperate to promote the common mode flux path and the first bridge segment and the second bridge segment cooperate to promote the differential mode flux path.

In another embodiment, the invention provides an apparatus for essentially eliminating motor overvoltages due to resonances in the motor cable system. The apparatus includes a common mode/differential mode choke or inductor, three resistors and three capacitors. Each resistor is in series with a capacitor. Then each resistor and capacitor series is paralleled with each of the coils of the inductor. Each network of components is linked between the drive and the three supply lines to the motor.

In another embodiment, the invention provides an apparatus for eliminating overvoltages due to resonances, the apparatus comprising: an inductor having common mode and differential mode flux paths, the inductor further including a first wiring arrangement and a second wiring arrangement; and a first circuit in parallel arrangement with the first wiring arrangement and a second circuit in parallel arrangement with the second wiring arrangement, each of the first circuit and the second circuit including a respective capacitive element and a respective resistive element in series arrangement.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof, as well as additional items. Unless specified or limited otherwise, the terms "mounted," "connected," "supported," and "coupled" and variations thereof encompass both direct and indirect mountings, connections, supports, and couplings. Further, "connected" and "coupled" are not restricted to physical or mechanical connections or couplings.

The entire contents of U.S. Provisional Patent Application No. 61/046,939, U.S. Provisional Patent Application No. 61/084,668 and U.S. Pat. No. 5,990,654 are fully incorporated herein by reference.

Figure 2:
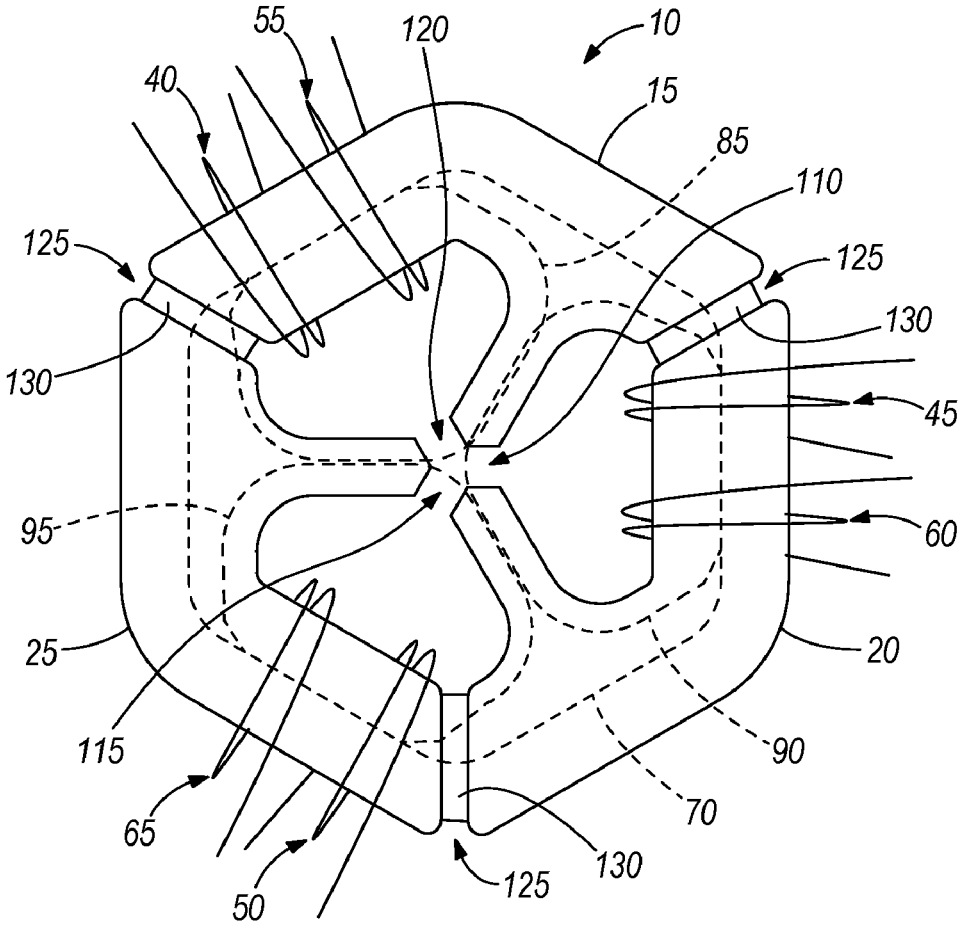
FIG. 2 is a top view of an inductor according to a first embodiment of the invention.
Figure 3:
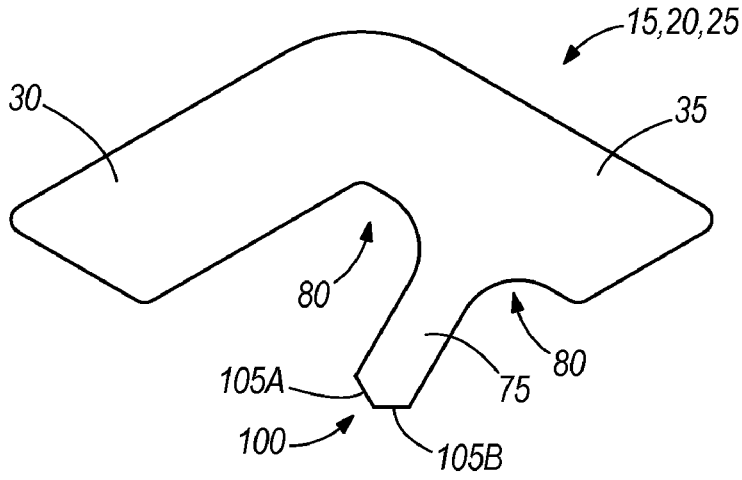
FIG. 3 is a top view of a core element of the inductor in FIG. 2.
Figure 20:
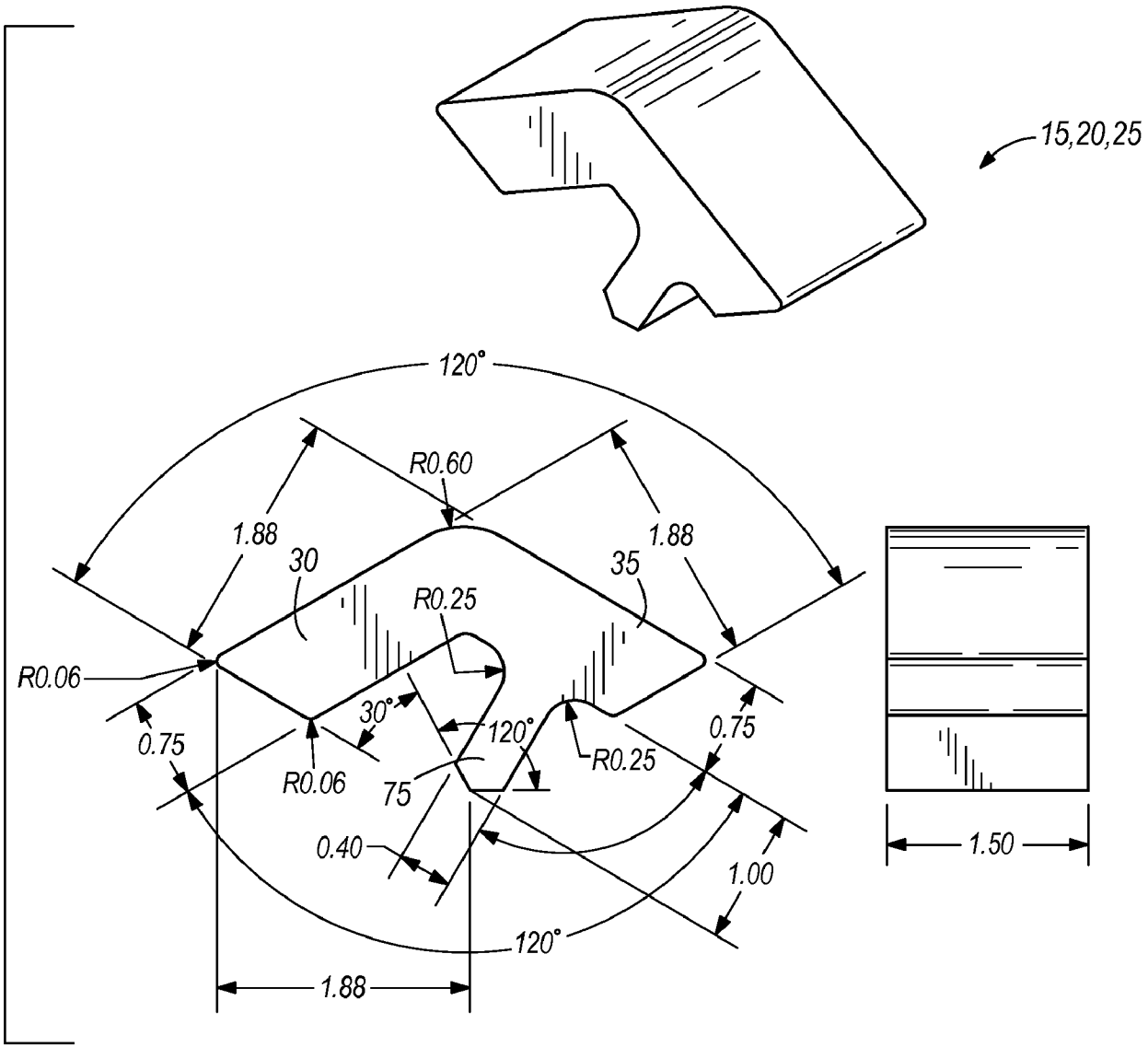
FIG. 20 is a detailed view of a core element of an inductor according to first embodiment of the invention.
Figure 21:
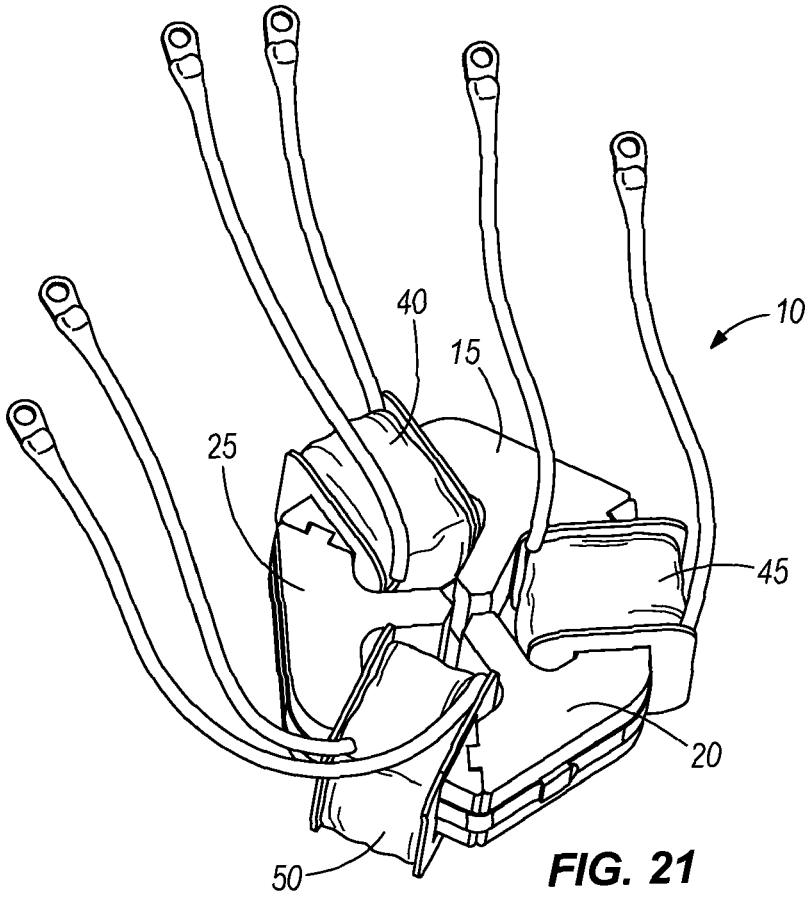
FIG. 21 is a top view of an exemplary construction of an inductor according to the invention.
Figure 22:
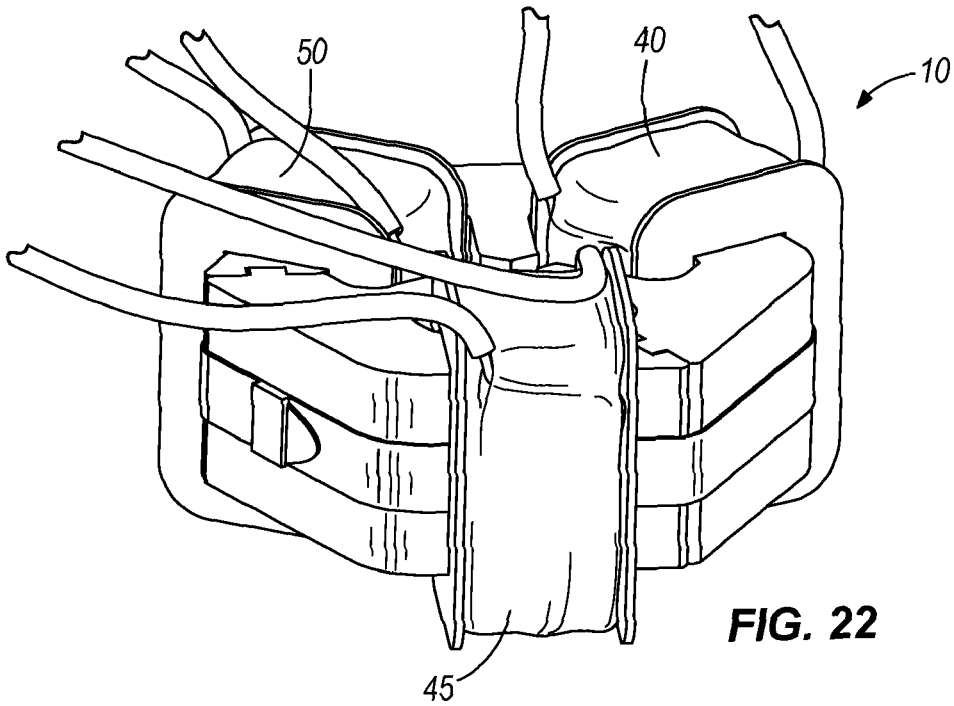
FIG. 22 is a detailed view of the exemplary construction in FIG. 21.

FIGS. 2, 21 and 22 illustrate an inductor or filter 10 according to a first embodiment of the invention. The inductor 10 includes three core elements or structures 15, 20, 25. Some skilled in the art may also refer to the structures 15, 20, 25 as, simply, cores. Each of the cores 15, 20, 25 is a unitary piece and is manufactured from a magnetic material such as powdered iron, molypermalloy, ferrite or sendust. FIGS. 3 and 20 show more specifically the shape of a single core element 15, 20, 25.

In the illustrated construction of FIGS. 2, 3, and 20-22, each core 15, 20, 25 includes a first segment or leg 30 and a second segment or leg 35 extending from one end of the first leg 30. The first leg 30 and the second leg 35 define an angle of about 120 degrees therebetween. As illustrated, the legs 30 of each of the core structures 15, 20, 25 are utilized to support windings 40, 45, 50, respectively. Further, in the construction illustrated in FIG. 2, the first leg 30 of each of the core structures 15, 20, 25 also supports a second set of windings 55, 60, 65, respectively. The leg 30 can have a rectangular cross section, which allows coils (e.g., the wiring arrangement illustrated in FIG. 19) to be wound on similar cross-section shaped bobbins to slide onto leg 30 of the corresponding core structure 15, 20, 25. As illustrated in FIG. 2, the legs 30, 35 of the cores 15, 20, 25 form a common mode flux path 70.

Figure 1A:
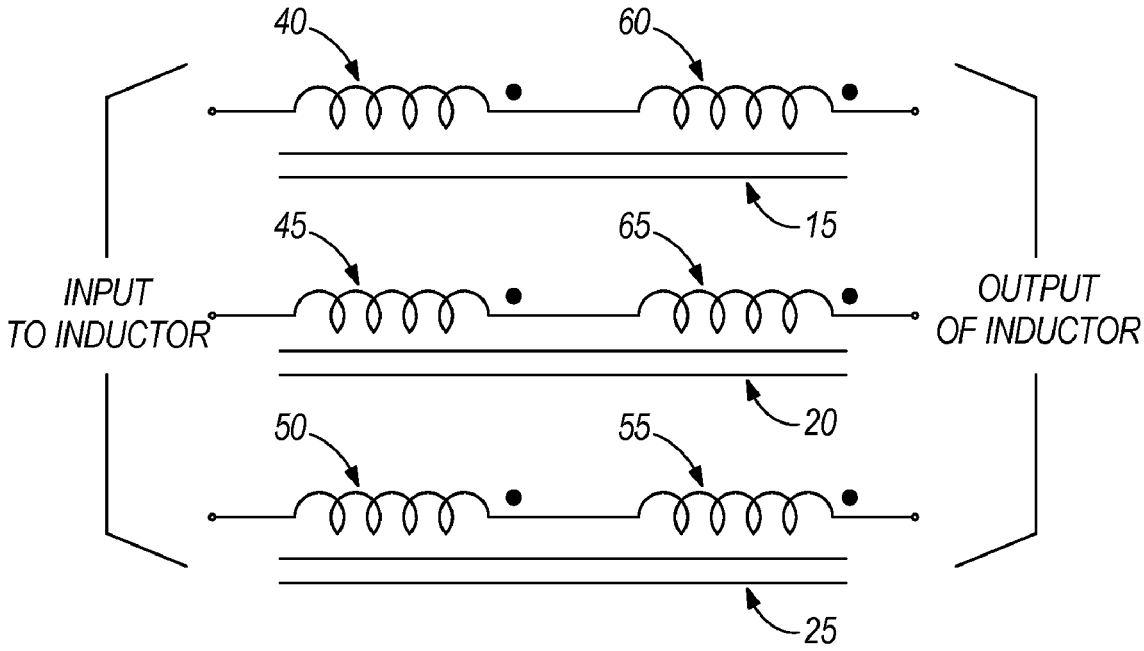
FIG. 1*a* schematically illustrates a first wiring arrangement of an inductor according to the invention.
Figure 1B:
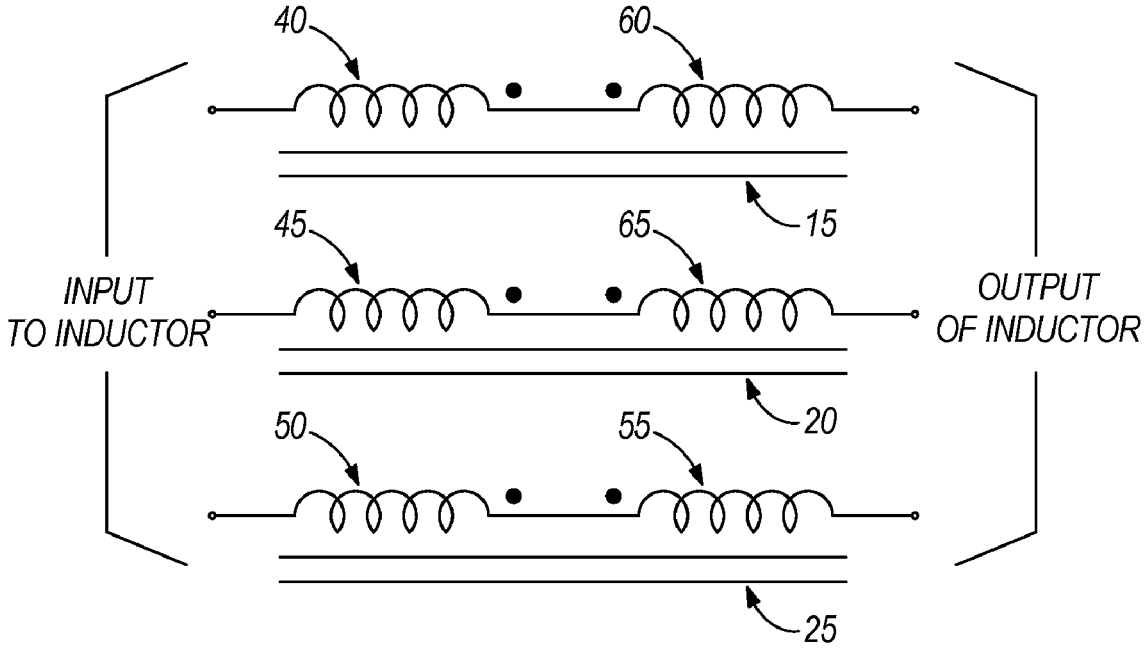
FIG. 1*b* schematically illustrates a second wiring arrangement of an inductor according to the invention.
Figure 1C:
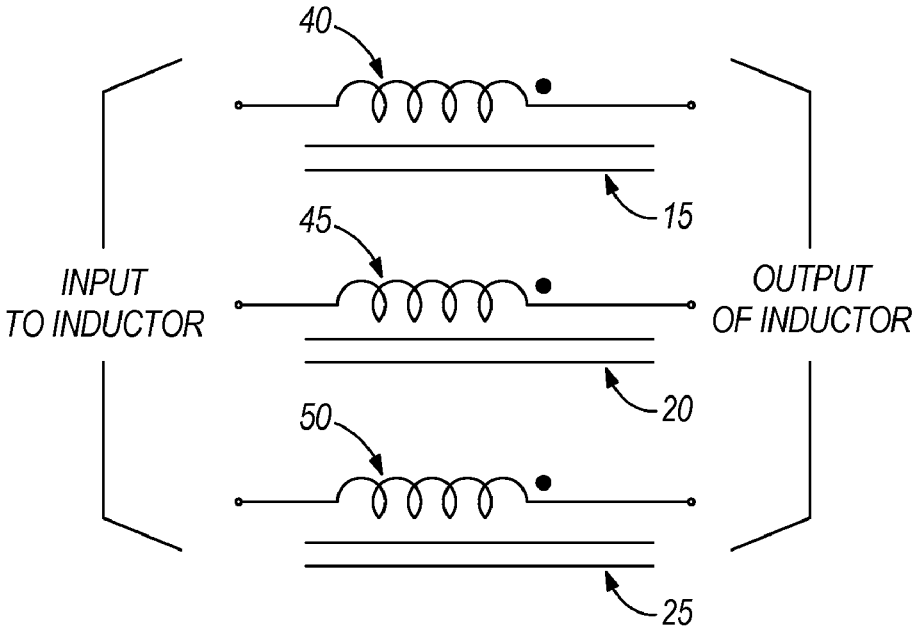
FIG. 1*c* schematically illustrates a third wiring arrangement of an inductor according to the invention.

FIGS. 1*a*, 1*b* and 1*c* illustrate three wiring arrangements for inductors according to the invention. For ease of description, the numbers referenced in FIGS. 1*a*, 1*b* and 1*c* for describing the wiring arrangements correspond to the numbers of wiring arrangements in FIGS. 2, 4, 6, 8, and 10. Particularly, FIG. 1*c* illustrates an arrangement where each of the core structures (e.g., cores 15, 20, 25 in FIG. 2) supports a single coil 40, 45, 50. FIGS. 1*a* and 1*b* illustrate arrangements where each of the core structures 15, 20, 25 supports two coils 40 and 55, 45 and 60, and 50 and 65. FIG. 1*a* shows wiring arrangements where coils 40 and 55, 45 and 60, or 50 and 65 on each core 15, 20, 25 have the same orientation for strengthening magnetic flux. FIG. 1*b* shows wiring arrangements where coils 40 and 55, 45 and 60, or 50 and 65 on each core 15, 20, 25 of have opposite orientations for weakening flux, as further explained below. It is to be understood that the arrangements illustrated in FIGS. 1*a*, 1*b* and 1*c* are applicable to all inductors described in this application and to other inductors incorporating the invention but not specifically described herein.

In the illustrated construction, each core 15, 20, 25 also includes a radially oriented segment or core bridge 75. Accordingly, the inductor 10 includes a total of three core bridges 75. The three core bridges 75 extend toward the center of the inductor 10 and each core bridge 75 extends from one corresponding leg 35 of cores 15, 20, 25. With specific reference to FIGS. 3 and 20, the core bridge 75 extends substantially perpendicular from the leg 35 and the width of the bridge 75 is relatively smaller than the width of each of the legs 30, 35. The cores 15, 20, 25 are manufactured to form a radius 80 between the walls of the bridge 75 and leg 35. The radius 80 between the core bridges 75 and legs 35 provide additional mechanical support between the core legs 35 and bridges 75. The core bridges 75 in cooperation with corresponding legs 30, 35 form three differential mode flux paths 85, 90, 95.

In the illustrated construction, the end of each of the core bridges 75 forms a point end 100 (with respect to the top view in FIG. 3, for example) defining two end walls 105A, 105B. End walls 105A, 105B of each core bridge 75 are adjacent to and substantially parallel with other end walls 105A, 105B of the core bridges 75. The point ends 100 distribute the flux evenly along the ends of the core bridges 75. The arrangement of the core bridges 75 of the inductor 10, and particularly of the end walls 105A, 105B, can help reduce localized saturation of the cores 15, 20, 25. In the illustrated construction, each end wall 105A, 105B and the corresponding adjacent end wall 105A, 105B of adjacent core bridges 75 form a space of non-magnetic material 110, 115, 120 substantially at the center of the inductor 10 and between each of the core bridges 75. The material is typically air or a potting material.

With reference to FIG. 2, the inductor 10 also includes three exterior gaps 125 between end portions of adjacent legs 30, 35 of core structures 15, 20, 25. The reluctance of the common mode flux path 70 for a given core shape is controlled by the permeability of the material. Since there is, typically, a limited number of standard material permeabilities used to design the core structure, the resulting size may not be optimal. The exterior gaps 125 of the illustrated constructions allow for the control of the reluctance of the common mode flux path 70. Particularly, adjusting the size of the external gap 125 and selecting the material of the core 15, 20, 25 allow adjusting the core permeability. For example, the further the core structures 15, 20, 25 are spaced apart due to the thickness of external spacers 130 filling or forming the gaps 125, the lower the common mode inductance is.

The flexibility in designing cores 15, 20, 25, based on selecting core material and/or adjusting the size of gaps 125, can allow producing an inductor (e.g., inductor 10) of relatively smaller size. In FIG. 2, the common mode inductance is illustrated as the common flux path 70. The external spacers 130 forming the gaps 125 can be constructed from nonmagnetic material such as Glastic or Nomex materials.

The amount of differential mode inductance (illustrated in FIG. 2 as the differential mode flux paths 85, 90, 95), as compared to the common mode inductance, can be adjusted during the design phase of the inductor 10 by adjusting and selectively changing the amount of space 110, 115, 120 in the center of the inductor 10 between the core bridges 75 and/or by changing the width of the core bridges 75. For example, cores (e.g., 15, 20, 25) that define smaller core spaces 110, 115, 120 generally have proportionately more differential mode inductance. In addition, cores that have wider core bridges 75 also have more differential mode inductance.

Another method for adjusting common mode inductance is to vary the wiring arrangement. For example, the inductor illustrated in FIG. 2 includes two coils (e.g., coils 40, 55) mounted on each core 15, 20, 25. To increase common mode inductance, the wiring arrangements on each core 15, 20, 25 are arranged with the polarities as shown in FIG. 1*a*. In other words, the coils on each core 15, 20, 25 are arranged with the same polarity. Further, the greater the amount of turns in coils 55, 60, 65, as compared to coils 40, 45, 50, increases the common mode inductance. On the contrary, to decrease common mode inductance, the wiring arrangements on each core 15, 20, 25 are arranged with polarities as shown in FIG. 1*b*. The greater the amount of turns in coils 55, 60, 65, as compared to coils 40, 45, 50, decreases the common mode inductance.

Figure 4:
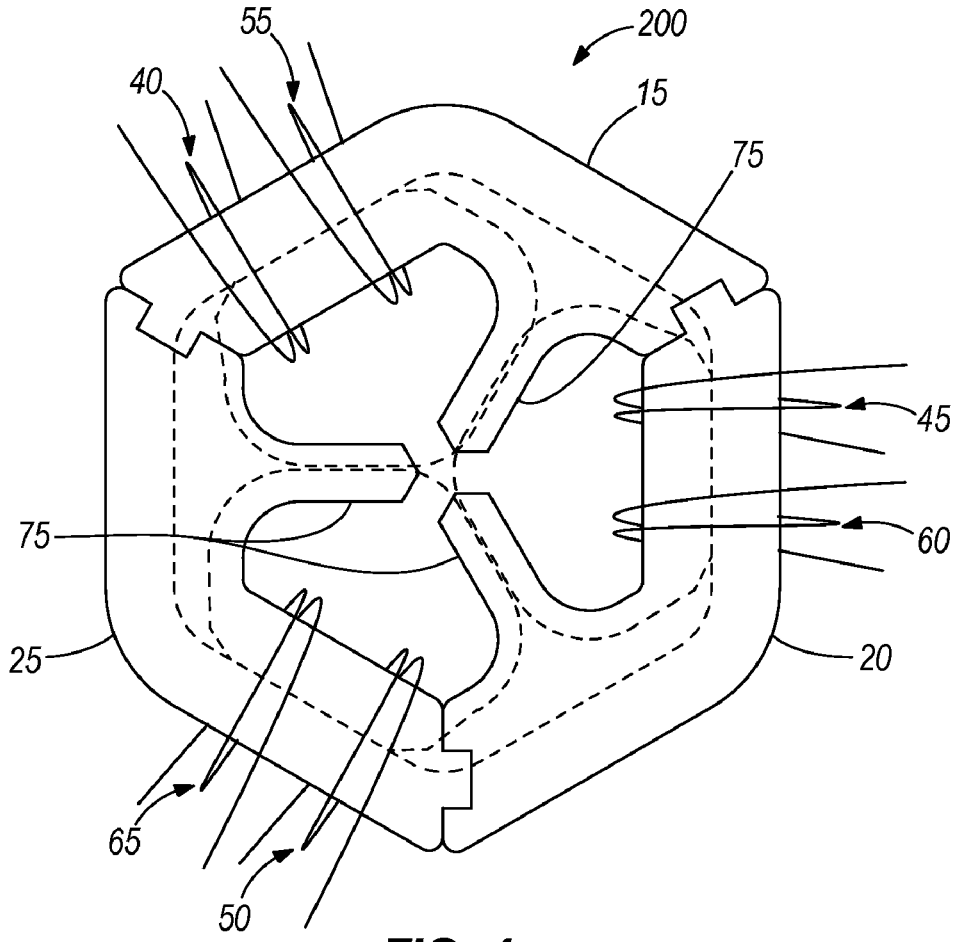
FIG. 4 is a top view of an inductor according to a second embodiment of the invention.
Figure 5:
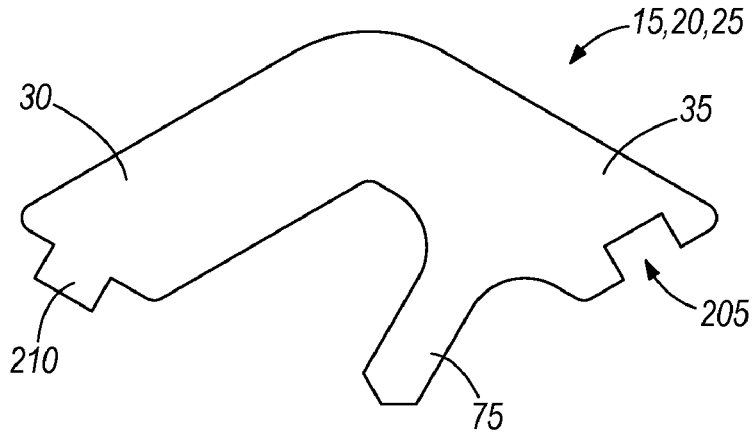
FIG. 5 is a top view of a core element of the inductor in FIG. 4.

FIGS. 4 and 5 illustrate an inductor or filter 200 according to a second embodiment of the invention. The inductor 200 includes many features in common with other inductors described in this application and common elements have been given the same reference numerals. Accordingly, reference is made to other inductors described in this application for additional features and alternatives to the inductor 200 and the following description makes reference to the differences between inductor 200 and other inductors described in this application.

In the illustrated construction, the use of the exterior core gaps 125, as described with respect to the inductor 10 in FIG. 2, are typically not used in the construction of inductor 200 of FIG. 4. Particularly, each core 15, 20, 25 includes attachment assemblies for coupling the cores to one another. As illustrated in FIG. 5, leg 35 of each core 15, 20, 25 has a notch 205 and leg 30 includes a protrusion 210. The notch 205 is designed to receive a corresponding protrusion 210 of the adjacent leg 30. The notches 205 and protrusions 210 assist in positioning of the core pieces 15, 20, 25 with respect to one another as shown in FIG. 4. As a result, assembly time is improved with respect to other inductor devices, and the variations of core positions that can affect inductance values are reduced. Other constructions of the inductor 200 can include a different number of notches 205 and protrusions 210 for assembling the inductor 200. Further, other attachment assemblies not specifically described herein fall within the scope of the invention.

Figure 6:
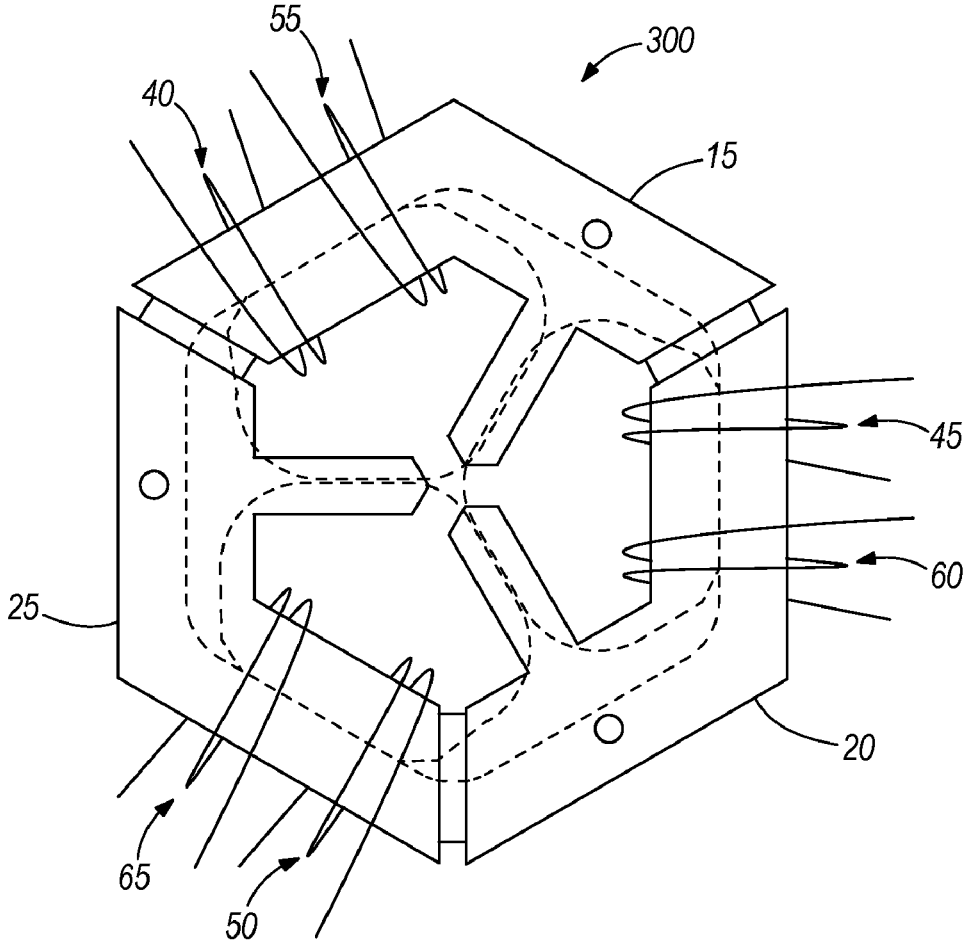
FIG. 6 is a top view of an inductor according to a third embodiment of the invention.
Figure 7:
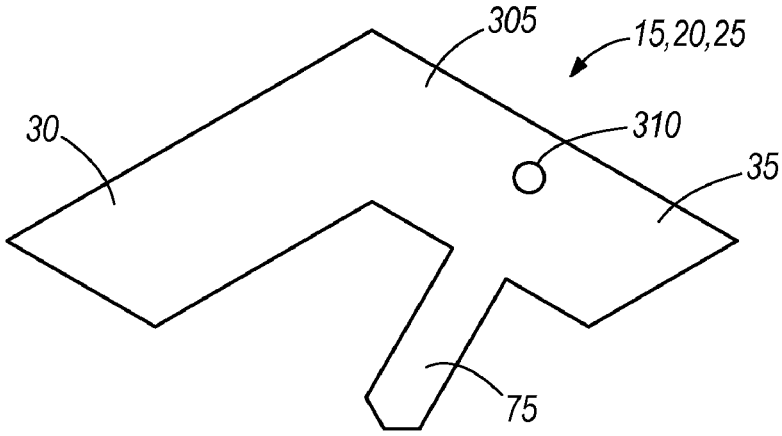
FIG. 7 is a top view of a portion of a core element of the inductor in FIG. 6.

FIGS. 6 and 7 illustrate an inductor or filter 300 according to a third embodiment of the invention. The inductor 300 includes many features in common with other inductors described in this application and common elements have been given the same reference numerals. Accordingly, reference is made to other inductors described in this application for additional features and alternatives to the inductor 300, and the following description makes reference to the differences between inductor 300 and other inductors described in this application.

In the illustrated construction, each of the cores 15, 20, 50 of inductor 300 is constructed from a number of stacked laminations 305. The laminations 305 can be made from stacked lamination material, such as silicon steel or nickel iron. Each of the laminations 305 also includes a hole or aperture 310 placed into the lamination 305 for a holding mechanism (e.g., screw, bolt, nail) to support the lamination stack together. The location of the hole 310 is "under" the core bridges 75 and near the outer (or peripheral) edge of the core leg 35. That is, the hole 310 is formed in alignment with respect to the longitudinal direction of the core bridge 75 and adjacent the outer edge of the core 15, 20, 25.

The hole 310 is formed in the illustrated location because that location of the core has a lower flux density than other portions of the core as measured or determined prior to forming the hole 310 in the stack of laminations 305. In other words, as determined from a core without the hole 310 therein. As a consequence, adding or forming the hole 310, as illustrated in FIG. 7, increases the flux density around the hole 310. However, the impact of forming the hole 310, as illustrated, has limited negative or detrimental impact in the operation of the inductor 300. In addition, the radius 80 between the core bridges 75 and legs 35 that provides additional mechanical support between the core legs 35 and bridges 75 (FIG. 2) is not required (even though it may be present) in the construction of the cores 15, 20, 25 of inductor 300. This particular feature is not necessary because the metallic laminations 305 have enough strength without the radius 80 as shown in FIG. 3.

Figure 8:
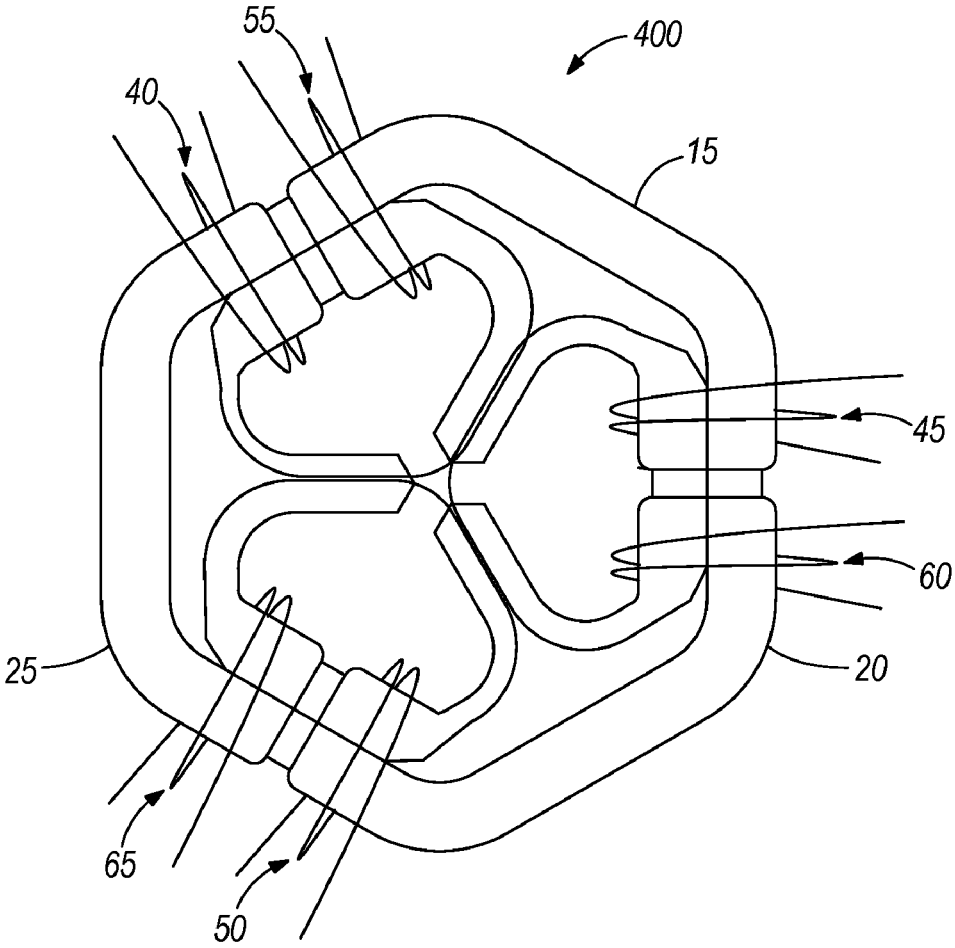
FIG. 8 is a top view of an inductor according to a fourth embodiment of the invention.
Figure 9:
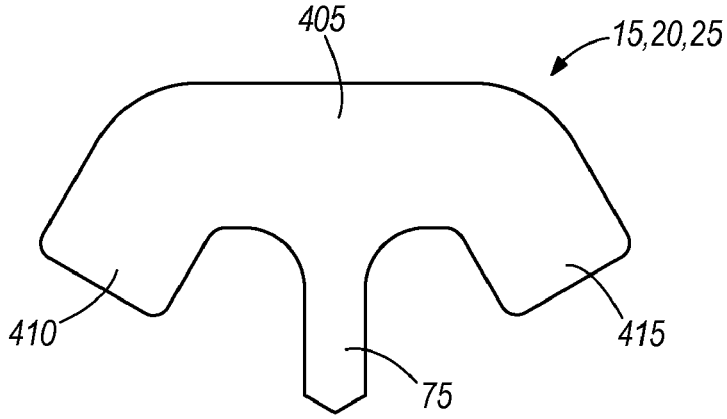
FIG. 9 is a top view of a core element of the inductor in FIG. 8.

FIGS. 8 and 9 illustrate an inductor or filter 400 according to a fourth embodiment of the invention. The inductor 400 includes many features in common with other inductors described in this application and common elements have been given the same reference numerals. Accordingly, reference is made to other inductors described in this application for additional features and alternatives to the inductor 400 and the following description makes reference to the differences between inductor 400 and other inductors described in this application.

In the illustrated construction, the inductor 400 as shown in FIG. 8 includes much of the same characteristics as the inductor 10 as shown in FIG. 2 with the difference that each of the exterior gaps 125 is located inside the wiring arrangements 40 and 55, 45 and 60, and 50 and 65. Placing the wire arrangements with respect to the exterior gaps 125, as shown in FIG. 8, restricts movement of the cores 15, 20, 25 and exterior gaps 125 in two directions (radially and circularly), thereby making the inductor 400 more consistent and easier to construct. This construction results in the gaps 125 being less accessible during assembly. However, the exterior gap thickness may still be adjusted during assembly of the inductor 400 to adjust the inductance value.

With specific reference to FIG. 9, the core 15, 20, 25 includes a substantially symmetrical construction with respect to a longitudinal axis of the core bridge 75. Particularly, the core 15, 20, 25 includes a center piece or segment 405 formed substantially perpendicular to the core bridge 75. First and second outer segments or legs 410, 415 each extends from the center piece 405 at an angle with respect to the center piece 405. It is to be understood that other configurations of the core 15, 20, 25 also fall within the scope of the invention.

Figure 10:
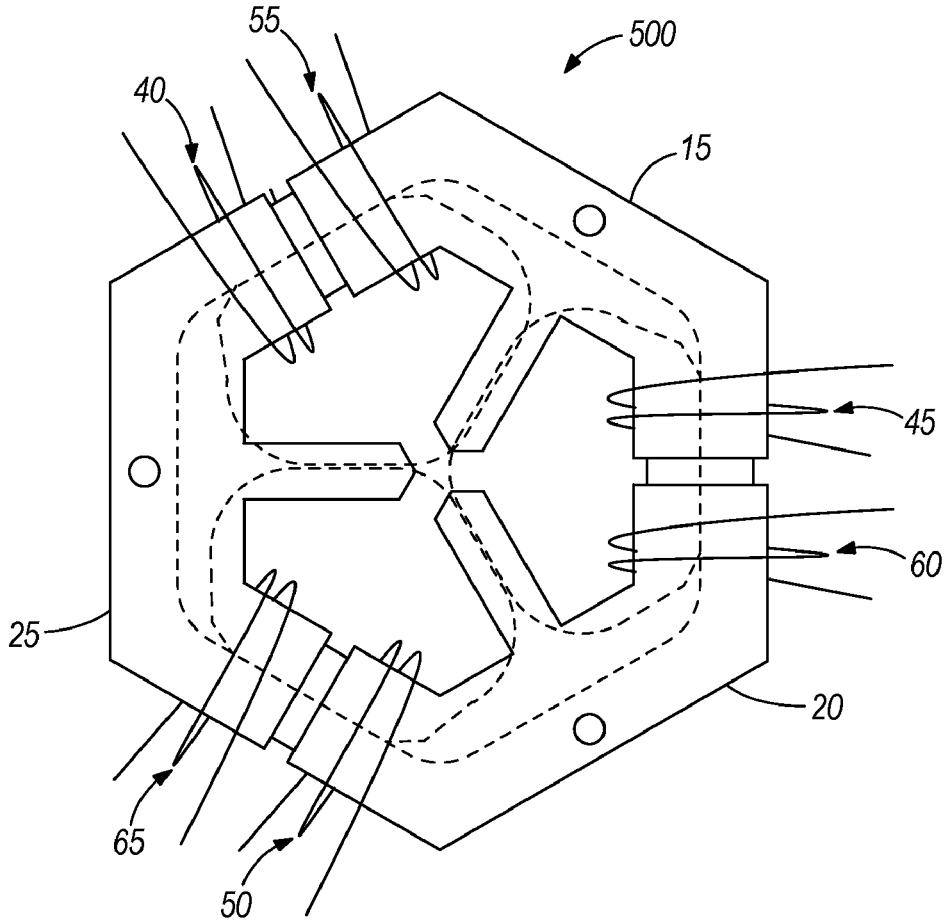
FIG. 10 is a top view of an inductor according to a fifth embodiment of the invention.
Figure 11:
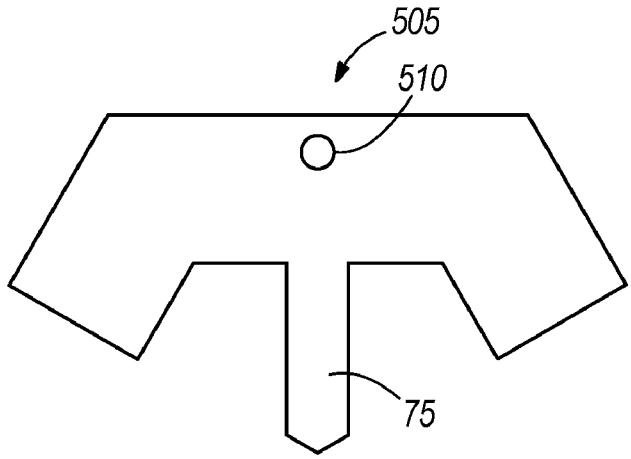
FIG. 11 is a top view of a portion of a core element of the inductor in FIG. 10.

FIGS. 10 and 11 illustrate an inductor 500 according to a fifth embodiment of the invention. The inductor 500 includes many features in common with other inductors described in this application, and common elements have been given the same reference numerals. Accordingly, reference is made to other inductors described in this application for additional features and alternatives to the inductor 500 and the following description makes reference to the differences between inductor 500 and other inductors described in this application.

The illustrated construction of the inductor 500 includes much of the same characteristics as the construction of inductor 400 shown in FIG. 8, with the difference that the core structure 15, 20, 25 is constructed from stacked lamination material such as silicon steel or nickel iron. Particularly, lamination plates 505, such as the one illustrated in FIG. 11, include a similar structure as the core 15, 20, 25 illustrated in FIG. 9 and also include holes or apertures 510 similar to the holes 310 discussed with respect to FIGS. 6 and 7. Lamination plates 505 also include a center piece or segment 515 and first and second outer segments or legs 520, 525 extending from then center piece 515. Laminations 505 can include other configurations that also fall within the scope of the invention.

Figure 19:
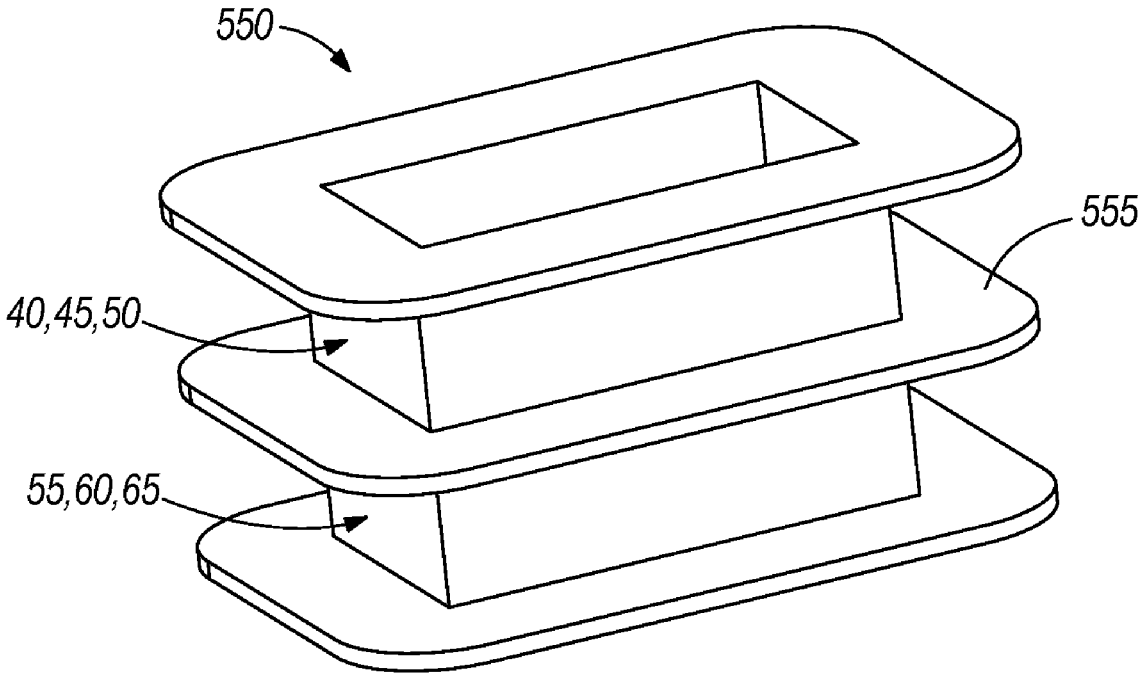
FIG. 19 is a perspective view of a wiring arrangement of an inductor according to the invention.

Windings or wiring structures 40, 45, 50 and windings or wiring structures 55, 60, 65, if included, of the exemplary constructions shown in FIGS. 12, 14, 16, 17 can be wound with magnet wire, Litz wire, lead wire, or copper foil. For example, the construction of each wiring structure, such as the wiring structures illustrated in FIG. 17, can includes a bobbin 530, 535, 540 generally formed from rynite or glass-filled nylon. The coils may be terminated with terminals, leads, or crimps. FIG. 19 illustrates a bobbin 550 with coils as illustrated in FIGS. 1*a* and 1*b*. The bobbin 550 shown in FIG. 19 has a dividing flange 555 to control the amount of mutual inductance between coils due to proximity with respect to each other. The bobbins 530, 535, 540 can include an integral termination. Other methods and techniques for winding and terminating coils are known in the art, and consequently, the bobbin type construction needs not be discussed further herein.

Figure 12:
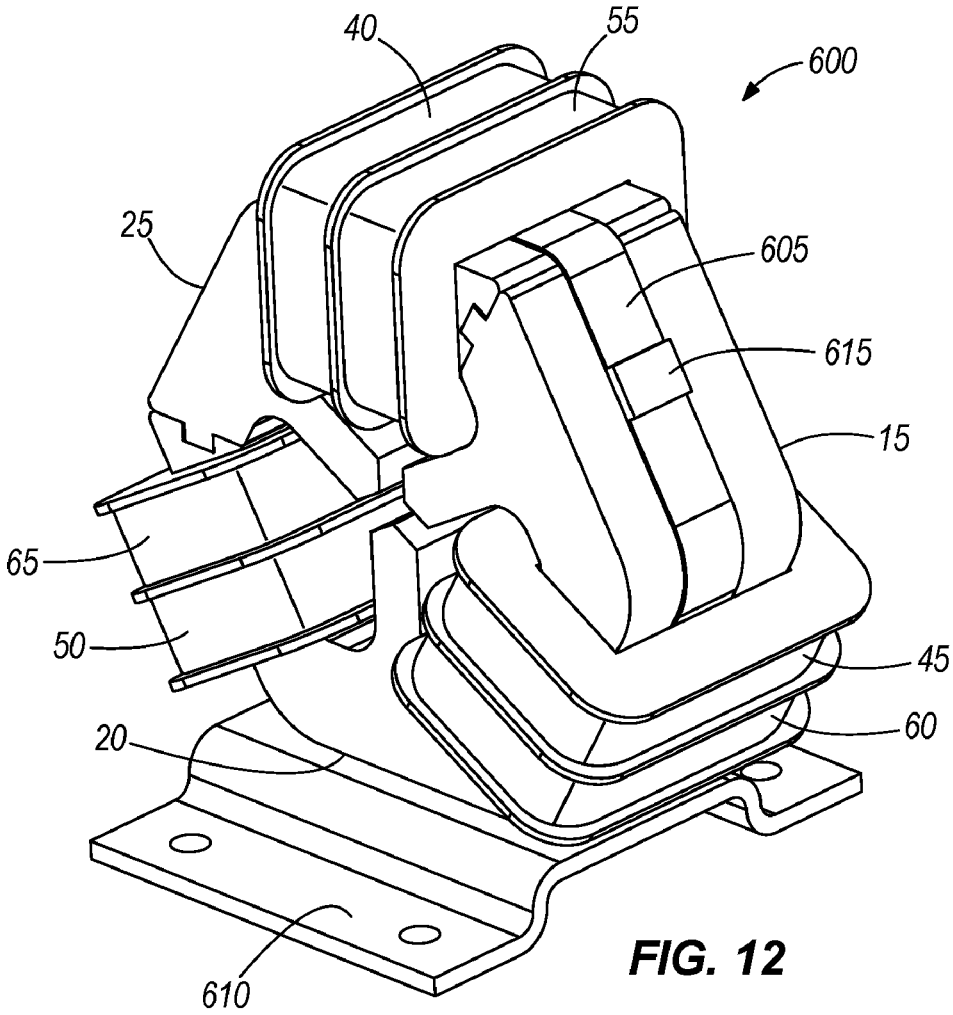
FIG. 12 is a perspective view of an exemplary construction of the inductor in FIG. 4.
Figure 13:
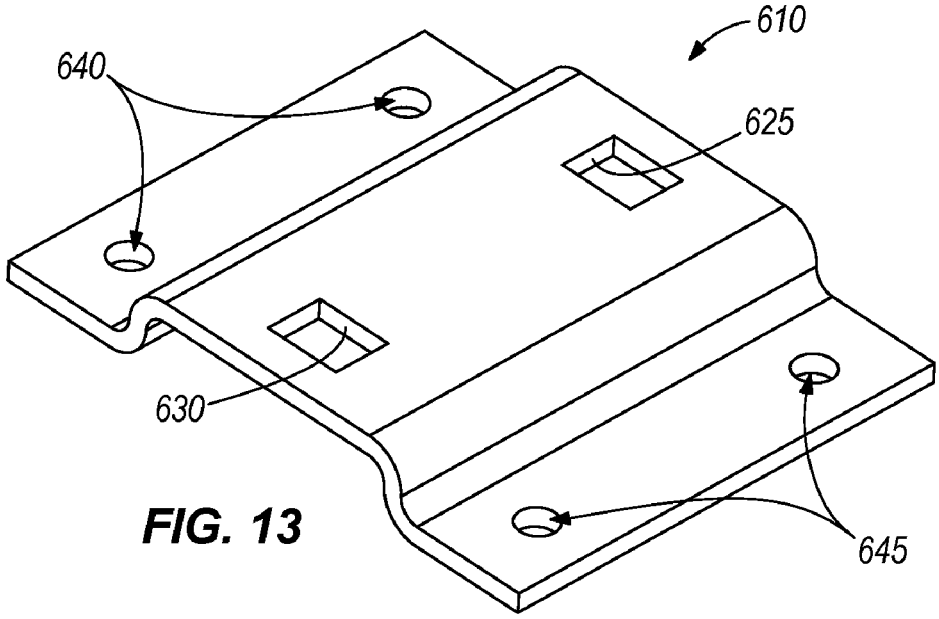
FIG. 13 is a perspective view of a mounting plate of the inductor in FIG. 12.

FIGS. 12 and 13 illustrate an exemplary construction of an inductor or filter 600 according to an embodiment of the invention. The inductor 600 includes many features in common with other inductors described in this application and common elements have been given the same reference numerals. Accordingly, reference is made to other inductors described in this application for additional features and alternatives to the inductor 600 and the following description makes reference to the differences between inductor 600 and other inductors described in this application.

FIG. 12 illustrates an exemplary construction of an inductor 600 according to the invention. Particularly, FIG. 12 shows a mechanical construction that can be used to make an inductor as shown in the embodiments described with respect to FIGS. 2, 4 and 8. The inductor 600 includes a metal banding strap 605, typically made from steel or stainless steel. The strap 605 is placed around the outside of the core pieces 15, 20, 25 and through a mounting bracket 610. The strap 605 also includes a banding clip 615 for securing the strap 605 around the cores 15, 20, 25. FIG. 13 illustrates the mounting bracket 610 of the inductor 600 for supporting the cores 15, 20, 25. The mounting bracket 610 includes two openings 625, 630 for the strap 605 to go through. The mounting bracket 610 also includes holes 640, 645 for receiving attachment mechanisms and mounting the inductor 600 at a desired location. In other constructions, the mounting bracket 610 does not include holes 640, 645 and other means for coupling the inductor 600 are utilized, such as captive fasteners (e.g., clamps). In the illustrated construction, the bracket 610 provides a separation between the cores 15, 20, 25 and the surface (not shown) where the inductor is mounted to. However, other configurations of the bracket 610 fall within the scope of the invention.

Figure 14:
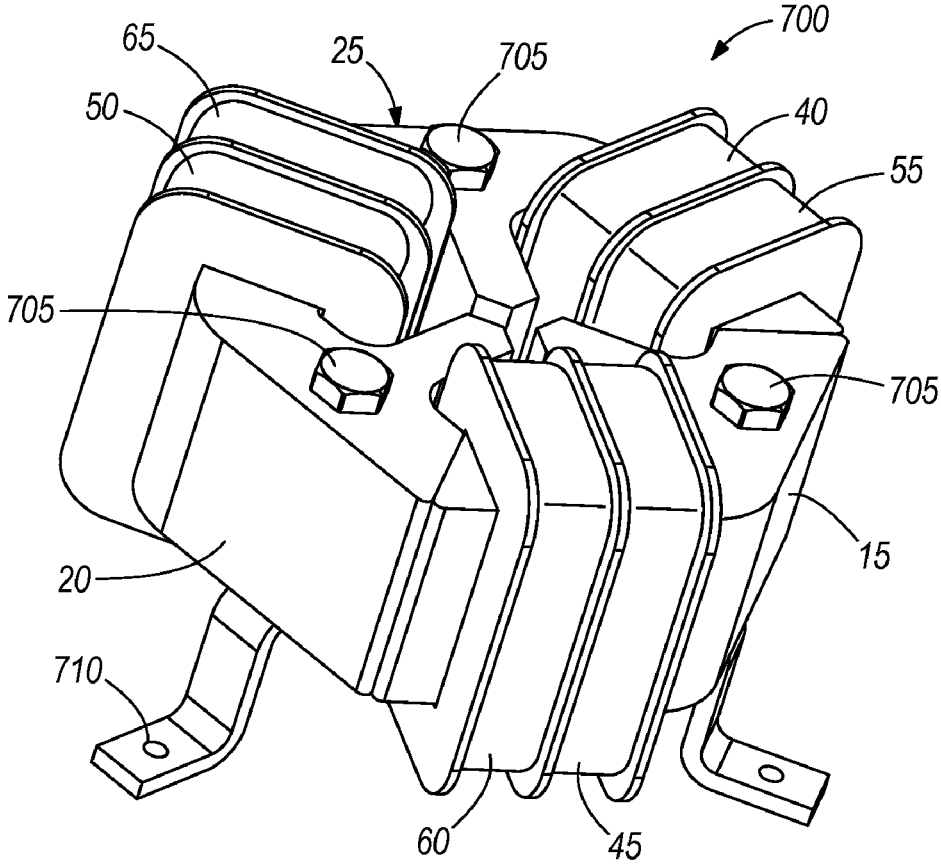
FIG. 14 is a perspective view of an exemplary construction of the inductor in FIG. 10.
Figure 15:
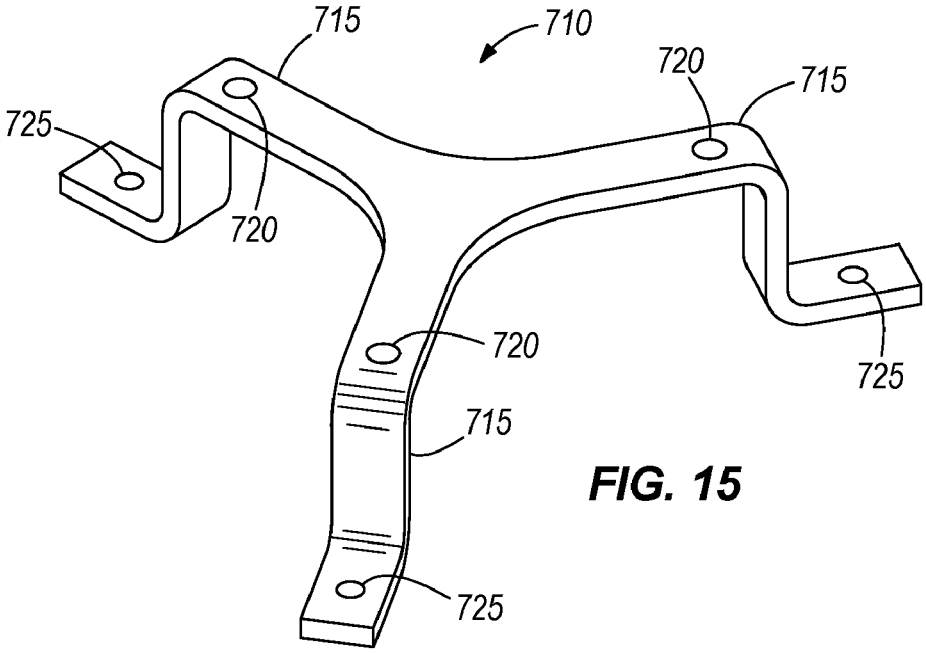
FIG. 15 is a perspective view of a mounting bracket of the inductor in FIG. 14.

FIGS. 14 and 15 illustrate another exemplary construction of an inductor or filter 700 according to an embodiment of the invention. The inductor 700 includes many features in common with other inductors described in this application and common elements have been given the same reference numerals. Accordingly, reference is made to other inductors described in this application for additional features and alternatives to the inductor 700 and the following description makes reference to the differences between inductor 700 and other inductors described in this application.

FIG. 14 illustrates an exemplary construction of the inductor 700 according to the invention. Particularly, FIG. 14 shows a mechanical construction that can be used to make an inductor as shown in the embodiments described with respect to FIGS. 6 and 10. In the illustrated construction, three screws 705 are placed through core holes (i.e., holes formed by apertures 510 of laminations 505 in FIG. 11) to attach cores 15, 20, 25 to a metal mounting bracket 710 of the inductor 700. FIG. 15 shows a more detailed view of the mounting bracket 710 of inductor 700. The bracket 710 includes three legs 715 with receiving apertures 720 for receiving screws 705. In the illustrated construction, screws 705 can be retained with the bracket 710, thus securing cores 15, 20, 25, with respective nuts. Other constructions of the inductor 700 can include captive fasteners to secure the cores 15, 20, 25 to the bracket 710. The bracket 710 further includes attachment apertures 725 for receiving coupling mechanisms (e.g., screws, bolts, nails) and coupling the inductor 700 to a desired location. In the illustrated construction, the bracket 710 provides a separation between the cores 15, 20, 25 and the surface (not shown) where the inductor is mounted to. However, other configurations of the bracket 710 fall within the scope of the invention.

Figure 16:
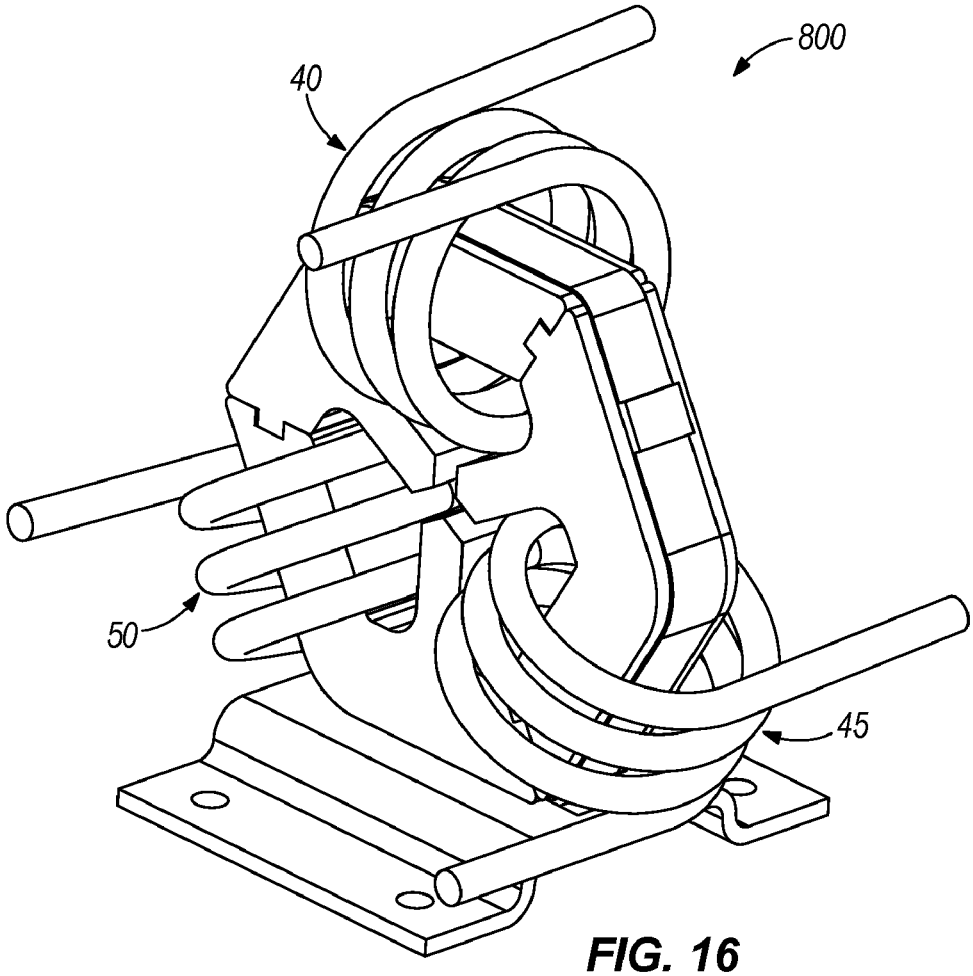
FIG. 16 is a perspective view of an exemplary construction of an inductor according to the invention.

FIG. 16 illustrates another exemplary construction of an inductor or filter 800 according to an embodiment of the invention. The inductor 800 includes many features in common with other inductors described in this application and common elements have been given the same reference numerals. Accordingly, reference is made to other inductors described in this application for additional features and alternatives to the inductor 800 and the following description makes reference to the differences between inductor 800 and other inductors described in this application.

In the illustrated construction, insulated cables 40, 45, 50 are each wound around leg 30 of a corresponding core section 15, 20, 25. During operation of the inductor 800, current from each phase of a three phase power system would be applied to leads 805, 810, 815 of each corresponding winding 40, 45, 50. Inductor 800 also includes a mounting bracket 820 similar to bracket 610 in FIG. 13 and a branding strap 825 similar to strap 605 in FIG. 12. For assembly purposes, the inductor 800 may be provided to the end customer as core assembly including cores 15, 20, 25 coupled as described above but without windings 40, 45, 50. The customer then could wind the required amount of turns around the core 15, 20, 25. Particularly, the customer can use insulated cable or wire in place of bobbins (e.g., bobbin 550 in FIG. 19) for other core assemblies or constructions.

Figure 17:
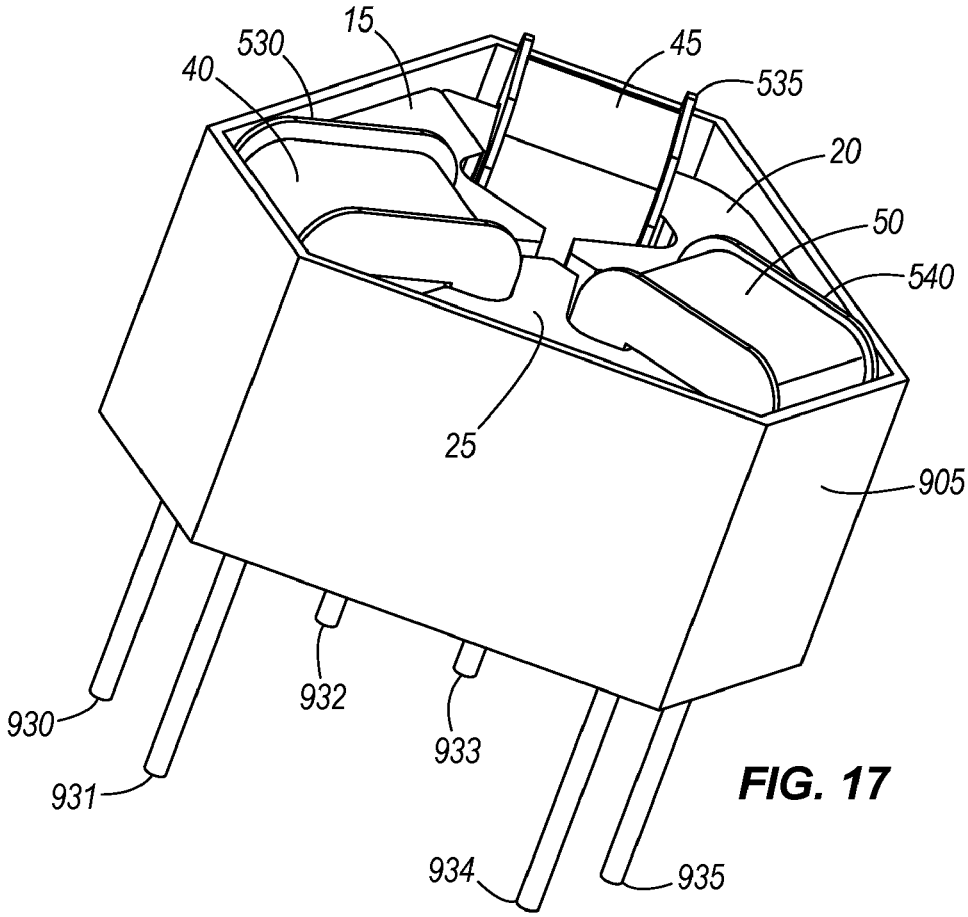
FIG. 17 is a perspective view of another exemplary construction of an inductor according to the invention.
Figure 18:
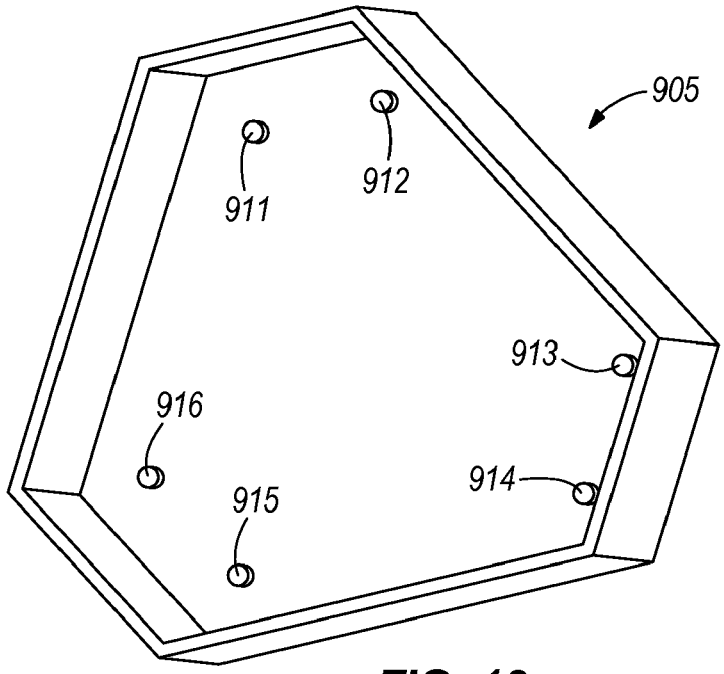
FIG. 18 is a perspective view of a cup of the exemplary construction in FIG. 17.

FIGS. 17 and 18 illustrate another exemplary construction of an inductor or filter 900 according to an embodiment of the invention. The inductor 900 includes many features in common with other inductors described in this application and common elements have been given the same reference numerals. Accordingly, reference is made to other inductors described in this application for additional features and alternatives to the inductor 900 and the following description makes reference to the differences between inductor 900 and other inductors described in this application.

In the illustrated construction, cores 15, 20, 25, bobbins 530, 535, 540, and windings 40, 45, 50 are placed into a cup 905. The cup 905, which is also shown in FIG. 18, can be filled with an electrical potting compound, such as epoxy, to secure the cores 15, 20, 25, bobbins 530, 535, 540, and windings 40, 45, 50 into place. The terminals 930, 931, 932, 933, 934, 935 can be self leads from the windings 40, 45, 50 or can be constructed from wire of another gauge. The leads from the coils can be soldered into place. As illustrated in FIG. 18, the cup 905 includes six holes or apertures 911, 912, 913, 914, 915, 916 for receiving terminals 930, 931, 932, 933, 934, 935 therethrough. Also, the cup 905 defines an irregular hexagonal shape. However, other forms or configurations of the cup 905 fall within the scope of the invention.

Figure 23:
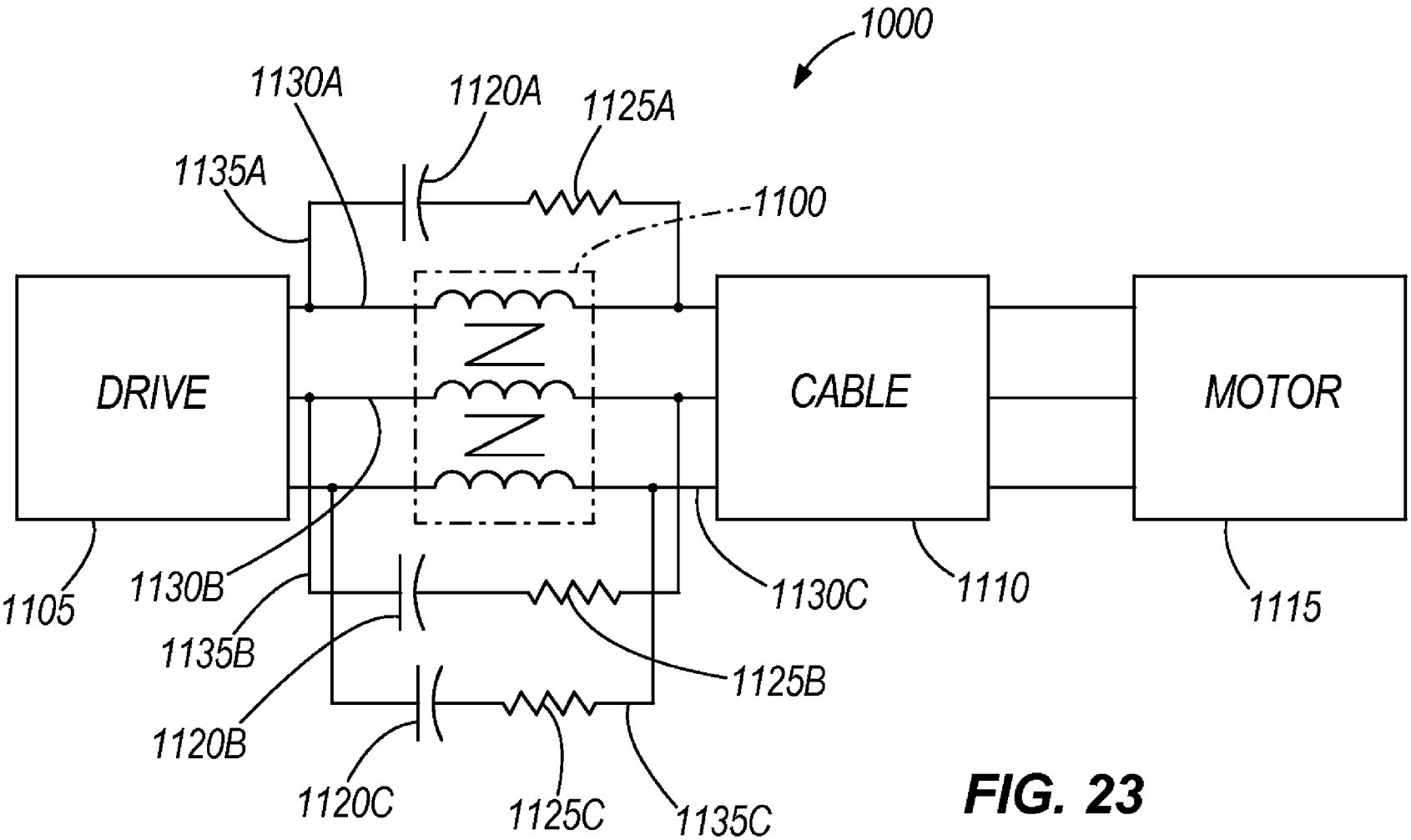
FIG. 23 is a schematic view of a circuit incorporating an inductor according to the invention.

FIG. 23 is a schematic representation of an apparatus or circuit 1000 including an inductor or filter 1100 connected between a drive circuit 1105 and a cable system that is in turn connected to a motor 1115. It is to be understood that the inductor 1100 can include any combination of the characteristics and limitations of an inductor as described in the present application. Accordingly, no further description of the inductor 1100 is necessary. The inductor 1100 includes three wiring arrangements 1130A, 1130B, 1130C electrically connecting the drive 1105 to cable system 1110 that leads to the motor 1115.

In addition, the circuit 1000 includes three circuits 1135A, 1135B, 1135C also connecting the drive 1105 to the cable system 1110. Each circuit 1135A, 1135B, 1135C is in parallel arrangement with one corresponding wiring arrangement 1130A, 1130B, 1130C. Each circuit 1135A, 1135B, 1135C also includes a capacitive element 1120A, 1120B, 1120C and a resistive element 1125A, 1125B, 1125C. It is to be understood that although only one capacitor and one resistor are shown in FIG. 23 for each circuit 1135A, 1135B, 1135C, the invention encompasses other suitable combinations of capacitive and resistive elements or other elements with capacitive and resistive properties.

A first improvement of the circuit 1000 over other circuits, such as the circuit illustrated in FIG. 4 of U.S. Pat. No. 5,990,654, is that inductor 1100 incorporates the characteristics of previously separated or individual common mode inductors and differential mode inductors. This allows the reduction of size and cost of the components (e.g., magnetic components) in the filter 1100 and circuit 1000.

A second improvement of the circuit 1000 over other circuits, such as the circuit illustrated in FIG. 4 of U.S. Pat. No. 5,990,654, is the implementation of additional capacitive elements 1120A, 1120B, 1120C, which can be combined with resistive elements 1125A, 1125B, 1125C. More specifically, the teachings of U.S. Pat. No. 5,990,654 require that "[w]ith respect to carrier frequency range fc, it is desirable if the R-L impedance combination operates as a pure inductor with a 90 phase angle and zero impedance at carrier frequencies fc so as to facilitate complete current flow through the inductor, keep watts loss in the resistor to a minimum and so as to minimize ripple current."

In contrast with the teachings of U.S. Pat. No. 5,990,654, it is believed that capacitive elements 1120A, 1120B, 1120C of circuit 1000 having a value between about 0.100 uF to 0.500 uF offer high impedance at the carrier frequencies. This substantially eliminates any current at carrier frequencies through the resistive elements 1125A, 1125B, 1125C. As a consequence, the losses in the resistive elements 1125A, 1125B, 1125C are reduced, which also results in the reduction of size and/or cost of the circuit 1000 with respect to other circuits. Troublesome frequencies, such as the ones near the resonant frequency of the cable 1110, are mostly unaffected by the low impedance of the capacitive elements 1120A, 1120B, 1120C. It is to be understood that a person of ordinary skill in the art will readily recognize other advantages and improvements presented by circuit 1000 but not specifically discussed herein.

Various features and advantages of the invention are set forth in the following claims.

What is claimed is:

1. An inductor including common mode and differential mode flux paths, the inductor comprising:

a first core having a first segment, a second segment extending from the first segment and a first bridge segment extending from the second segment;

a first wiring arrangement at least partially disposed around the first segment;

a second core having a third segment, a fourth segment extending from the third segment and a second bridge segment extending from the fourth segment;

a second wiring arrangement at least partially disposed around the third segment;

a third core having a fifth segment, a sixth segment extending from the fifth segment and a third bridge segment extending from the sixth segment;

a third wiring arrangement at least partially disposed around the fifth segment; and wherein the first segment, second segment, third segment, fourth segment, fifth segment and sixth segment cooperate to promote the common mode flux path, and the first bridge segment, the second bridge segment and the third bridge segment extend substantially toward a central axis of the inductor and cooperate to promote the differential mode flux path.

2. The inductor of claim 1, wherein the second segment extends from a longitudinal end of the first segment.

3. The inductor of claim 1, wherein the first segment and the second segment define a 120 degree angle therebetween.

4. The inductor of claim 1, wherein the first bridge segment extends substantially perpendicular from the second segment.

5. The inductor of claim 1, wherein the first core is a single piece of metal material and wherein an arcuate wall at least partially defines the second segment and the first bridge segment.

6. The inductor of claim 1, wherein the first core includes a plurality of laminations stacked together.

7. The inductor of claim 6, wherein each of the laminations include an aperture in relation with the first bridge segment, the apertures of the laminations forming a core aperture for receiving a fastener.

8. The inductor of claim 1, wherein the first wiring arrangement includes a first coil and a second coil disposed around the first segment, the first coil being electrically connected to the second coil for affecting the common mode flux path.

9. The inductor of claim 1, wherein a longitudinal end of the first bridge segment opposite the second segment is adjacent a longitudinal end of the second bridge segment opposite the fourth segment, the separation between the longitudinal end of the first bridge segment and the longitudinal end of the second bridge segment affecting the differential mode flux path.

10. The inductor of claim 1, wherein a longitudinal end of the first segment opposite the second segment is adjacent a longitudinal end of the fourth segment opposite the third segment such that the longitudinal end of the first segment and the longitudinal end of the fourth segment form a gap therebetween for affecting the common mode flux path.

11. The inductor of claim 10, wherein a spacer including a nonmagnetic material is placed within the gap for affecting the common mode flux path.

12. The inductor of claim 1, further comprising a band extending the periphery of the first core and the second core for coupling the first core and the second core to one another, and a supporting bracket receiving the band for securing the first core and the second core to the bracket.

13. A method of manufacturing an inductor having common mode and differential flux paths, the method comprising:

providing a first core having a first segment, a second segment extending from the first segment and a first bridge segment extending from the second segment;

disposing a first wiring arrangement at least partially around the first segment;

providing a second core having a third segment, a fourth segment extending from the third segment and a second bridge segment extending from the fourth segment;

disposing a second wiring arrangement at least partially around the third segment;

providing a third core having a fifth segment, a sixth segment extending from the fifth segment and a third bridge segment extending from the sixth segment;

disposing a third wiring arrangement at least partially around the fifth segment; and arranging the first core, the second core, and the third core such that the first segment, second segment, third segment, fourth segment, fifth segment, and sixth segment define a central portion of the inductor and cooperate to promote the common mode flux path and the first bridge segment, the second bridge segment and the third bridge segment extend into the central portion of the inductor and cooperate to promote the differential mode flux path.

14. The method of claim 13, wherein placing the first core adjacent the second core includes placing a longitudinal end of the first segment opposite the second segment adjacent a longitudinal end of the fourth segment opposite the third segment.

15. The method of claim 14, further comprising adjusting the distance between the longitudinal end of the first segment and the longitudinal end of the fourth segment to affect the common mode flux path.

16. The method of claim 14, further comprising selectively forming a gap between the longitudinal end of the first segment and the longitudinal end of the fourth segment to affect the common mode flux path.

17. The method of claim 16, further comprising placing a spacer including a nonmagnetic material within the gap for affecting the common mode flux path.

18. The method of claim 13, wherein placing the first core adjacent the second core includes placing a longitudinal end of the first bridge segment opposite the second segment adjacent a longitudinal end of the second bridge segment opposite the fourth segment.

19. The method of claim 18, further comprising adjusting the distance between the longitudinal end of the first bridge segment and the longitudinal end of the second bridge segment for affecting the differential mode flux path.

20. The method of claim 18, further comprising adjusting the width of at least one of the first bridge segment and the second bridge segment for affecting the differential mode flux path.

21. The method of claim 13, wherein the first wiring arrangement includes a first coil and a second coil, wherein the disposing the first wiring arrangement includes mounting the first coil and the second coil on the first segment, and wherein the method further comprises electrically coupling the first coil with the second coil.

22. The method of claim 21, wherein the mounting the first coil and the second coil includes placing the first coil in the same orientation as the second coil.

23. The method of claim 21, wherein the mounting the first coil and the second coil includes placing the first coil in the opposite orientation as the second coil.

24. The method of claim 13, further comprising providing a band and a supporting bracket, placing the band along the periphery of the first core and the second core, and coupling the first core and the second core to the bracket with the band.

25. An apparatus for eliminating overvoltages due to resonances, the apparatus comprising:

a three-phase inductor having common mode and differential mode flux paths, the inductor further including a first core, a second core, and a third core, each core having a first segment, a second segment extending from the first segment, respectively, and a bridge segment extending from the second segment, respectively, and a first wiring arrangement, a second wiring arrangement and a third wiring arrangement disposed around each respective first segment; and a first circuit in parallel arrangement with the first wiring arrangement, a second circuit in parallel arrangement with the second wiring arrangement, and a third circuit in parallel with the third wiring arrangement, each of the first circuit, the second circuit, and the third circuit including a respective capacitive element and a respective resistive element in series arrangement, wherein the bridge segments extend substantially toward a central axis of the three-phase inductor.

26. A motor assembly comprising a drive, a motor, and the apparatus of claim 25 connected in circuit between the drive and the motor.

* * * * *